US008382879B2

(12) United States Patent
Motomura et al.

(10) Patent No.: US 8,382,879 B2
(45) Date of Patent: Feb. 26, 2013

(54) COPPER SMELTING METHOD

(75) Inventors: Tatsuya Motomura, Oita (JP); Yoshiaki Suzuki, Oita (JP); Masaharu Takahashi, Oita (JP); Mitsumasa Hoshi, Oita (JP)

(73) Assignee: Pan Pacific Copper Co., Ltd., Tokyo (JP)

( * ) Notice: Subject to any disclaimer, the term of this patent is extended or adjusted under 35 U.S.C. 154(b) by 275 days.

(21) Appl. No.: 12/432,598

(22) Filed: Apr. 29, 2009

(65) Prior Publication Data

US 2009/0293678 A1 Dec. 3, 2009

(30) Foreign Application Priority Data

Jun. 2, 2008 (JP) ..... 2008-144706

(51) Int. Cl.
*C22B 15/14* (2006.01)
*C22B 7/04* (2006.01)

(52) U.S. Cl. ..... 75/645; 75/650

(58) Field of Classification Search ..... 75/649, 75/650

See application file for complete search history.

(56) References Cited

U.S. PATENT DOCUMENTS

| | | | | |
|---|---|---|---|---|
| 4,470,845 | A * | 9/1984 | Yannopoulos | 75/629 |
| 6,436,169 | B2 * | 8/2002 | Hirai et al. | 75/640 |
| 2001/0049982 | A1 | 12/2001 | Hirai et al. | |
| 2004/0244534 | A1 * | 12/2004 | Kojo et al. | 75/643 |
| 2005/0199095 | A1 | 9/2005 | Hanniala et al. | |

FOREIGN PATENT DOCUMENTS

| | | | |
|---|---|---|---|
| CN | 1659293 | A | 8/2006 |
| DE | 31 40 260 | A1 | 6/1982 |
| JP | 57-94532 | A | 6/1982 |
| JP | 58-221241 | A | 12/1983 |
| JP | 61-246331 | A | 11/1986 |
| JP | 08-209261 | A | 8/1996 |
| JP | 2001-247922 | A | 9/2001 |
| JP | 3217675 | B2 | 10/2001 |
| JP | 2002-180143 | A | 6/2002 |
| JP | 2002-383859 | A | 12/2002 |
| JP | 2003-064427 | A | 3/2003 |
| JP | 2003-64427 | A | 3/2003 |
| JP | 2004-2916 | A | 1/2004 |
| JP | 3529317 | B2 | 5/2004 |
| JP | 2005-8985 | A | 1/2005 |
| JP | 2007-231326 | A | 9/2007 |
| JP | 2007-270288 | A | 10/2007 |

OTHER PUBLICATIONS

ASM Metals Handbook, 1984, American Society for Metals, Desk Edition, p. 21-10.*

(Continued)

*Primary Examiner* — George Wyszomierski
*Assistant Examiner* — Tima M McGuthry Banks
(74) *Attorney, Agent, or Firm* — Birch, Stewart, Kolasch & Birch, LLP

(57) ABSTRACT

A copper smelting method includes: supplying an oxygen-enriched gas, a solvent, and a copper concentrate into a furnace, while not supplying a coke material; and supplying pig iron to slag that is generated in the furnace.

6 Claims, 2 Drawing Sheets

OTHER PUBLICATIONS

Japanese Office Action (with English translation) issued on May 11, 2010 in corresponding Japanese patent application No. 2008-144706.

Ang Zheng-tong: Formation and Control of Fe304 in the Procedure of Copper Flash Smelting, Mining & Metallurgy, Dec. 2002, pp. 69-72; vol. 11; No. 4: Jinlong Copper Co., Ltd.; Tongling. Anhui 244021, China.

Chinese Office Action issued in corresponding Chinese patent application No. 200810174608.0 (with English translation) on May 6, 2010.

Chinese Office Action issued in corresponding Chinese patent application No. 200810174608.0 (with English translation) on Apr. 27, 2011.

Improving Self Heating Degree of Copper Smelting and Reducing Energy Consumption, Nonferrous Metal (refining portion), Jan. 31, 1990; pp. 30-34.

Korean Office Action dated Dec. 25, 2010 issued in corresponding Korean patent application No. 10-2008-100905 (with English translation).

* cited by examiner

COPPER SMELTING METHOD

CROSS-REFERENCE TO RELATED APPLICATION

This application is based upon and claims the benefit of priority of the prior Japanese Patent Application No. 2008-144706, filed on Jun. 2, 2008, the entire contents of which are incorporated herein by reference.

FIELD

The present invention relates to a copper smelting method.

BACKGROUND

In a copper dry smelting process, an imbalance is caused between the supply of raw materials such as a copper concentrate and a silica concentrate, and the supply of oxygen into a furnace. As a result, the amount of oxygen becomes too large relative to the raw materials. In this case, magnetite ($Fe_3O_4$) is generated in the slag. Since a $Fe_3O_4$ layer or a layer containing a large amount of $Fe_3O_4$ has a higher melting point than the slag existing near the layer, the layer is not put into a liquid state, but remains in a semi-molten state in the furnace. As a result, the semi-molten layer blocks a slag tap hole, and hinders the operation of the furnace by reducing the inner volume of the furnace, for example. Also, a layer containing a large amount of $Fe_3O_4$ has high viscosity, and might hinder precipitation separation of a valuable metal such as copper suspended in the slag. This might lead to a decrease in valuable metal collection rate.

Therefore, to lower production costs and increase the valuable metal collection rate, it is essential that generation of $Fe_3O_4$ is restrained in a copper dry smelting process.

Japanese Patent Application Publication No. 58-221241 discloses a technique for restraining generation of $Fe_3O_4$. By this method, pulverized coke and pulverized coal as well as a copper concentrate are blown onto the slag surface, and the $Fe_3O_4$ is reduced to FeO by the pulverized coke. In this manner, the viscosity of the slag is lowered.

Japanese Patent No. 3217675 points out the problem that the coating layer of the furnace refractory is damaged due to excessive reduction when the amount of added coal is too large, and discloses appropriate conditions such as the controlled particle size of coal, the controlled concentration of each component, and the likes, so as to achieve appropriate reactivity between $Fe_3O_4$ and pulverized coke. Japanese Patent No. 3529317 discloses a technique for reducing $Fe_3O_4$ to FeO by adding granular pig iron (metallic iron) to an intermediate layer formed between matte and slag.

A copper dry smelting process has the advantage that the oxidation heat of copper ore can be used to melt the copper ore. According to any of the techniques disclosed in the above references, however, it is necessary to use a coke material as supplemental fuel. As a result, the production costs become higher.

SUMMARY

An object of the present invention is to provide a copper smelting method by which generation of $Fe_3O_4$ is restrained while the production costs are lowered.

According to an aspect of the present invention, there is provided a copper smelting method including: supplying an oxygen-enriched gas, a solvent, and a copper concentrate into a furnace, while not supplying a coke material; and supplying pig iron to slag that is generated in the furnace.

The copper smelting method may be configured so that a sulfur/copper weight ratio in the copper concentrate is in the range of 0.85 to 1.15. The copper smelting method as claimed in claim 1 may further include adjusting a copper grade in matte generated in the furnace to 64 to 69 wt. %. The copper smelting method may further include adjusting a copper grade in matte generated in the furnace to 66 to 69 wt. %. The copper smelting method may further include adjusting a copper grade in the slag to 0.65 to 0.95 wt. %. The copper smelting method may be configured so that oxygen concentration in the oxygen-enriched gas is in the range of 70 to 80 vol. %. The copper smelting method may be configured so that the furnace is a flash furnace. The copper smelting method may be configured so that the pig iron contains 1 to 6 wt. % of carbon, 1 to 30 wt. % of copper, and has a particle size of 0.3 to 8 mm.

According to another aspect of the present invention, there is provided a copper smelting method including: supplying a copper concentrate having a sulfur/copper weight ratio of 0.85 to 1.15, a solvent, and an oxygen-enriched gas into a furnace; and supplying pig iron to slag that is generated in the furnace.

According to yet another aspect of the present invention, there is provided a copper smelting method including: supplying an oxygen-enriched gas, a solvent, and a copper concentrate into a furnace; supplying pig iron to slag that is generated in the furnace; and adjusting a copper grade in matte generated in the furnace to 64 to 69 wt. %.

DESCRIPTION OF EMBODIMENTS

The following is a description of a preferred embodiment of the present invention.

Figure 1:
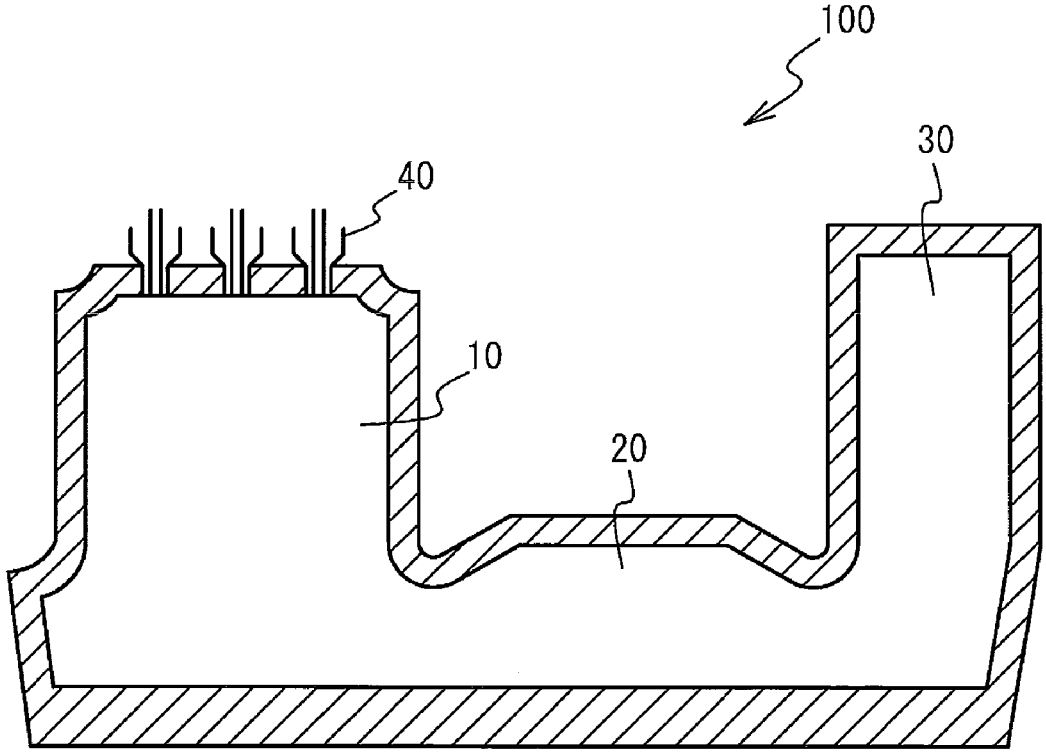
FIG. 1 is a schematic view of a flash furnace used in an embodiment of a copper smelting method in accordance with the present invention.

FIG. 1 is a schematic view of a flash furnace 100 that is used in an embodiment of a copper smelting method. As shown in FIG. 1, the flash furnace 100 has a structure in which a reaction tower 10, a settler 20, and an uptake 30 are placed in this order. A concentrate burner 40 is provided at the upper portion of the reaction tower 10.

Figure 2A:
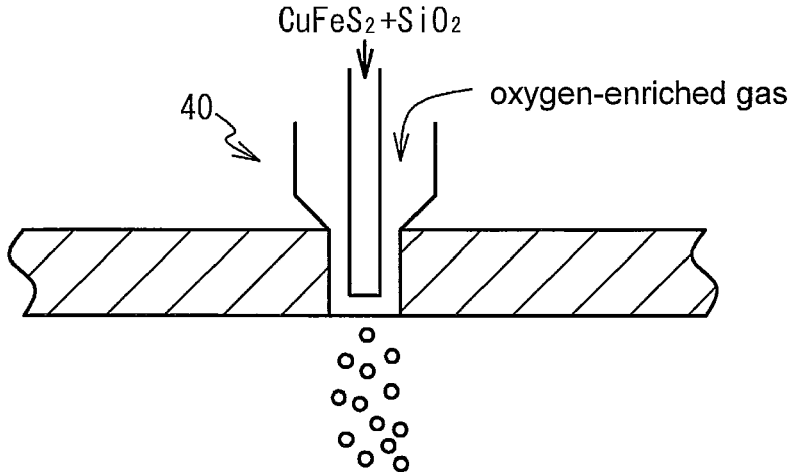
FIGS. 2A through 2C show the copper smelting procedures that involve the flash furnace.
Figure 2B:
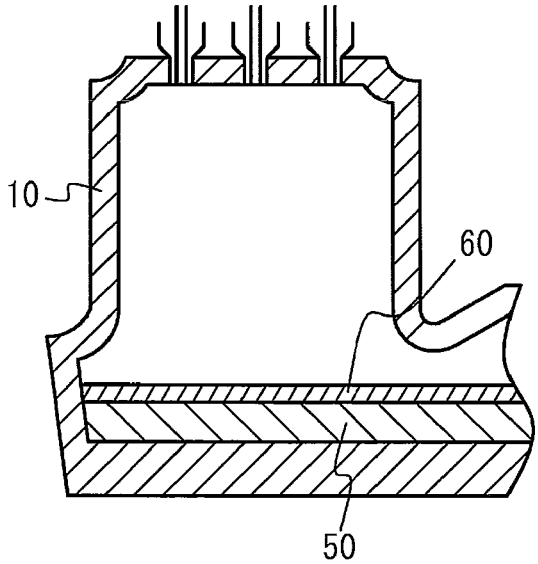
Figure 2C:
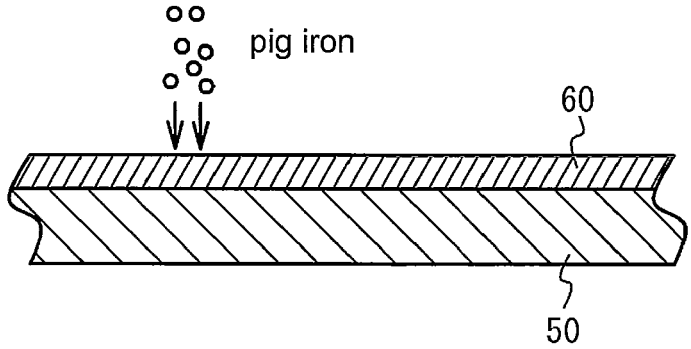

FIGS. 2A through 2C show the copper smelting procedures that involve the flash furnace 100. As shown in FIG. 2A, a copper concentrate, a silica concentrate, and an oxygen-enriched gas are simultaneously blown into the furnace through the concentrate burner 40. As a result, the copper concentrate has an oxidation reaction according to the reaction formula (1) shown below. As shown in FIG. 2B, the copper concentrate then turns into matte 50 and slag 60 at the bottom of the reaction tower 10. In the reaction formula (1), $Cu_2S.FeS$ is equivalent to the primary component of the matte, and FeO. $SiO_2$ is equivalent to the primary component of the slag. The silica concentrate functions as a solvent.

$$CuFeS_2+SiO_2+O_2 \rightarrow Cu_2S.FeS+2FeO.SiO_2+SO_2+\text{heat of reaction} \quad (1)$$

The oxygen-enriched gas is a gas that has higher oxygen concentration than the natural atmosphere. For example, the oxygen-enriched gas has oxygen concentration of 60 to 90 vol. %, and more preferably, has oxygen concentration of 70 to 80 vol. %. With this oxygen-enriched gas, it is possible to cause the copper concentrate to have a sufficient oxygen reaction. Also, the volume of the oxygen-enriched gas per 1 t of copper concentrate is 230.8 $Nm^3/t$ when the oxygen concentration is 70 vol. %, and is approximately 202.0 $Nm^3/t$ when the oxygen concentration is 80 vol. %.

As shown in FIG. 2C, pig iron (metallic iron) is supplied to the slag 60 in the settler 20. Since the iron (Fe), carbon (C), and the likes in the pig iron have a reduction action, generation of $Fe_3O_4$ in the slag 60 can be prevented. Also, since reaction heat is generated when Fe and C in the pig iron are oxidized, the quantity of heat can be maintained.

As described above, in accordance with the copper smelting method of this embodiment, the sufficient quantity of heat can be maintained, without the addition of a coke material as a heat source and a reduction agent. In a case where pig iron is used in place of a coke material, the cost of raw materials can be lowered. Accordingly, generation of $Fe_3O_4$ can be prevented while the production costs are lowered.

The sulfur concentration in the copper concentrate is not particularly limited. However, when the sulfur concentration in the copper concentrate is high, a large quantity of oxidation reaction heat is obtained from the sulfur. Therefore, it is preferable that the sulfur concentration is higher. For example, it is preferable that the weight ratio S/Cu between sulfur and copper in the copper concentrate is in the range of 0.85 to 1.15, and it is more preferable that the weight ratio S/Cu is in the range of 0.90 to 1.15. It is even more preferable that the weight ratio S/Cu is in the range of 1.00 to 1.15. In this case, the quantity of heat can be maintained without a coke material serving as a heat source. In this manner, the production costs can be lowered. In a case where the temperatures of the matte 50 and the slag 60 in the furnace become too high or too low, the oxygen concentration in the oxygen-enriched gas is made higher or lower, so as to adjust the temperatures of the matte 50 and the slag 60.

Also, a large quantity of heat can be obtained by oxidizing the sulfur in the matte 50. Accordingly, it is preferable to adjust the copper grade in the matte 50 to a high level. For example, it is preferable that the copper grade is adjusted to 64 to 69 wt. %, and it is more preferable that the copper grade is adjusted to 66 to 69 wt. %. Also, it is preferable to adjust the copper grade in the slag 60 to 0.65 to 0.95 wt. %. In those cases, the temperatures of the matte 50 and the slag 60 are adjusted to appropriate levels. In this manner, the quantity of heat can be maintained without the addition of a coke material serving as a heat source.

The pig iron that can be used in this embodiment is not particularly specified. For example, the pig iron is an iron-containing material that is produced from a waste incinerator, a recycling furnace, or the like, contains 80 wt. % or more of metallic iron (90 to 97 wt. % of Fe, for example), has a true specific gravity of 3 to 8, and has a particle size of 0.3 to 8 mm. It is preferable that the pig iron contains 1 to 6 wt. % of carbon, and 1 to 30 wt. % of copper. Having the above particle size, the pig iron becomes very reactive, and facilitates a reduction reaction.

Although a flash furnace is used in this embodiment, the present invention is not limited to that arrangement. For example, the present invention may also be applied to other dry smelting processes.

EXAMPLES

In accordance with the above embodiment, copper smelting was performed.

Examples 1 through 4

In Example 1 through 4, pig iron was supplied to slag, without a coke material serving as a heat source. The pig iron used in the examples was a material that contained 90 to 96 wt. % of Fe, 2 to 6 wt. % of C, and 1 to 5 wt. % of copper, had a true specific gravity of 3 to 8, and had a particle size of 0.3 to 8 mm. Table 1 shows the amounts of added pig iron, the weight ratios S/Cu in the copper concentrate, the oxygen concentrations in the oxygen-enriched gas, the copper grades in the matte, and the copper grades in the slag. In Table 1, each amount of added pig iron is shown as the amount per it, which is the total amount of the copper concentrate, the silica concentrate, and a mixed matter of looping materials at a smelter.

Comparative Example

In Comparative Example, a coke material was added, but pig iron was not added. Table 1 also shows the other conditions of Comparative Example.

TABLE 1

| | amount of added coke (kg/t) | amount of added pig iron (kg/t) | S/Cu (wt. %) | oxygen concentration (vol. %) | copper grade in matte (wt. %) | copper grade in slag (wt. %) |
|---|---|---|---|---|---|---|
| Example 1 | 0 | 1.2 | 0.90 | 70 | 67.5 | 1.10 |
| Example 2 | 0 | 1.1 | 1.00 | 75 | 68.0 | 0.90 |
| Example 3 | 0 | 1.6 | 1.05 | 70 | 67.5 | 0.90 |
| Example 4 | 0 | 1.7 | 1.13 | 75 | 65.0 | 0.80 |
| Comparative Example | 13 | 0 | 0.83 | 62 | 65.0 | 0.80 |

(Analysis)

The matte temperature, slag temperature, and $Fe_3O_4$ concentration of each of Example 1 through 4 and Comparative Example were measured. The measurement results are shown in Table 2.

TABLE 2

| | matte temperature (° C.) | slag temperature (° C.) | Fe3O4 concentration (wt. %) |
|---|---|---|---|
| Example 1 | 1230 | 1240 | 12.0 |
| Example 2 | 1250 | 1267 | 10.0 |
| Example 3 | 1240 | 1273 | 8.0 |
| Example 4 | 1230 | 1260 | 9.0 |
| Comparative Example | 1250 | 1270 | 11.0 |

As shown in Table 2, the $Fe_3O_4$ concentration was restrained to a relatively low value in Comparative Example.

This may be because generation of $Fe_3O_4$ is restrained by the reduction action of the coke material.

In Examples 1 through 4, the $Fe_3O_4$ concentration was restrained to a low level, even though a coke material was not used. This may be because generation of $Fe_3O_4$ is restrained by the reduction action of the pig iron. In Examples 1 through 4, the matte temperature and the slag temperature were the same as those in Comparative Example.

In the flash furnace, the temperatures of the matte and slag are equal to or higher than the melting point, so that the matte and slag are in a liquid state and maintain reasonably high fluidity. The temperatures of the matte and slag are also adjusted to temperatures within the controlled temperature range of 1240±10° C., which is set with the melt loss of the furnace refractory being taken into consideration. If the quantity of heat is not sufficient, thermal compensation is performed. The thermal compensation is conventionally performed by combustion of a coke material. However, the appropriate quantity of heat can be maintained by the increase in the heat of the oxidation reaction with the oxygen-enriched gas caused by the increase in sulfur amount in the copper concentrate, and appropriately adjusting the oxygen concentration in the oxygen-enriched gas.

As described above, where a coke material is not supplied, generation of $Fe_3O_4$ can be restrained by the reduction action of pig iron. Also, heat is obtained through the supply of an oxygen-enriched gas and pig iron. Heat is also obtained by increasing the sulfur concentration in the copper concentrate. Heat is further obtained by increasing the copper grade in the matte and the copper grade in the slag.

The present invention is not limited to the specifically disclosed embodiments, but variations and modifications may be made without departing from the scope of the present invention.

What is claimed is:

1. A copper smelting method comprising:

supplying an oxygen-enriched gas, a solvent, and a copper concentrate into a reaction tower of a furnace, while not supplying a coke material;

supplying pig iron to slag that is generated in a settler of the furnace, and generating heat by oxidizing at least a part of Fe and sulfur in the copper concentrate and at least apart of Fe and C in the pig iron:

wherein:

a sulfur/copper weight ratio in the copper concentrate is in a range of from 1.05 to 1.15;

an oxygen concentration in the oxygen-enriched gas is in a range of from 60 to 90 vol. %;

and the pig iron contains 1 to 6 wt. % of carbon, 1 to 30 wt. % of copper, and has a particle size of 0.3 to 8 mm.

2. The copper smelting method as claimed in claim 1, further comprising adjusting a copper grade in matte generated in the furnace to 64 to 69 wt. %.

3. The copper smelting method as claimed in claim 1, further comprising adjusting a copper grade in matte generated in the furnace to 66 to 69 wt. %.

4. The copper smelting method as claimed in claim 1, further comprising adjusting a copper grade in the slag to 0.65 to 0.95 wt. %.

5. The copper smelting method as claimed in claim 1, wherein oxygen concentration in the oxygen-enriched gas is in the range of 70 to 80 vol. %.

6. The copper smelting method as claimed in claim 1, wherein the furnace is a flash furnace.

* * * * *